US005938963A

United States Patent [19]

Tanis

[11] Patent Number: 5,938,963

[45] Date of Patent: Aug. 17, 1999

[54] GASKET SHAPED HEATER

[76] Inventor: Peter G. Tanis, R.R. 4, P.O. Box 143, Glenwood, Minn. 56334

[21] Appl. No.: 09/088,249

[22] Filed: Jun. 1, 1998

Related U.S. Application Data

[60] Provisional application No. 60/048,440, Jun. 2, 1997.

[51] Int. Cl.[6] ..... H05B 3/02

[52] U.S. Cl. ..... 219/551; 219/538; 219/548; 219/549; 219/552

[58] Field of Search ..... 219/544, 549, 219/548, 529, 528, 535, 551, 205, 206; 338/306, 307, 308, 309; 123/142.5 R

[56] References Cited

U.S. PATENT DOCUMENTS

| | | | |
|---|---|---|---|
| 1,211,935 | 1/1917 | Groshans . | |
| 1,805,040 | 5/1931 | Groves . | |
| 2,252,337 | 8/1941 | Worthen . | |
| 2,680,185 | 6/1954 | Basile . | |
| 2,992,838 | 7/1961 | Wallace . | |
| 3,498,280 | 3/1970 | Zimmerer et al. . | |
| 4,213,029 | 7/1980 | Endicott, Jr. et al. | 219/209 |
| 4,372,261 | 2/1983 | Sarto . | |
| 4,794,228 | 12/1988 | Braun, Jr. | 219/415 |
| 5,121,929 | 6/1992 | Cobb . | |
| 5,196,673 | 3/1993 | Tanis . | |
| 5,210,393 | 5/1993 | Shier . | |
| 5,275,420 | 1/1994 | Rodenkirch . | |
| 5,354,074 | 10/1994 | Jinno . | |
| 5,380,014 | 1/1995 | Schaperkotter . | |
| 5,477,033 | 12/1995 | Bergholtz | 219/549 |
| 5,527,599 | 6/1996 | Hall et al. . | |
| 5,804,774 | 9/1998 | Ford et al. | 181/152 |

*Primary Examiner*—Teresa Walberg
*Assistant Examiner*—Vinod D. Patel
*Attorney, Agent, or Firm*—Burd, Bartz & Gutenkauf

[57] ABSTRACT

A gasket shaped heater for placement between parting surfaces of component housings of engines, gear housings, differential housings and similar structures. The heater preheats the components to facilitate cold weather starting or operation thereof. In one form of the invention the heater is semi-permanently attached to a parting surface of the component housing and has an outer metallic surface which interfaces with the standard gasket located between the connected components. In another form of the invention, the heater takes the place of the standard gasket normally interposed between the parting surfaces.

15 Claims, 6 Drawing Sheets

GASKET SHAPED HEATER

Reference is made to U.S. Provisional Patent Application Serial No. 60/048,440 filed Jun. 2, 1997.

FIELD OF INVENTION

The invention relates to heaters to facilitate cold weather starting and operation of mechanical components related to engines, power transmissions, gear housings and like structures.

BACKGROUND OF THE INVENTION

Engines, transmissions and geared mechanisms start and operate begrudgingly if at all in certain cold environments due to a variety of factors. These include the increased viscosity achieved by the oil associated with the components as a result of the low temperature, poor gear and bearing fit, and poor vaporization of fuel. For example, automotive and aircraft engines can be difficult to start in cold weather, and at the same time the associated transmission gears and differentials are sluggish until they warm up. Upon temperature decline, gear cases contract at a greater rate than the gears. Gears carrying shafts that ride on bearings contract less than the bearings, which can result in binding.

Various heaters have been devised in order to preheat the oil and associated mechanical components preparatory to operation. Such devices include electric emersion heaters for oil sumps and reservoirs, electrically heated connecting bolts, bond-on pad type electric heaters, and thermocouple well heaters.

The mechanical components under consideration are frequently contained in a housing that is either forged, stamped or cast. The housing comes apart at parting surfaces which require the use of a gasket when assembled in order to check fluid leak. Some of these housings are frequently routinely disassembled for maintenance. An example of this is the rocker cover of an aircraft cylinder head. A new gasket is required for each reassembly. Other such housings have exactly matching surfaces and are disassembled infrequently. Examples of this include the turbofan engine inlet to fan housing, and the snowmobile carburetor to cylinder head connection.

An approach to this problem is shown in U.S. Pat. No. 2,680,185 to Basile. That patent discloses a gasket heater for disposition between the cylinder block and cylinder head of an internal combustion engine. The gasket comprises a cork or cork like body encased in a sheet of thin deformable sheet material. A heater wire is embedded in the cork body. The cork presents an unsatisfactory material for embedding the heater due to its inability to withstand high temperatures.

SUMMARY OF THE INVENTION

The invention pertains to a gasket-shaped heater that is interposed between parting surfaces of a housing, typically of an engine, a gear transmission assembly, or a differential. The heater takes the shape of the standard gasket normally interposed between the two parting surfaces.

In one form of the invention the heater is interposed between the parting surfaces and functions as a gasket in addition to a heater. This form is most applicable to parting surfaces of the type that are exactly matching surfaces and are seldomly disengaged. The heater takes the form of a gasket made of an elastomer such as silicone rubber with a heating element embedded in it.

In another form of the invention, the heater takes the form of a gasket that is interposed between the parting surfaces and resides there in addition to the usual or standard gasket. This form finds application where the parting surfaces are frequently disassembled and the old gasket replaced prior to reassembly. In this form of the invention, one surface of the heater is metallic. The other surface of the heater is bonded to one of the parting surfaces, typically the most massive one. The heater presents a new parting surface for mating with a gasket when juxtaposed with the opposite parting surface. That is, the regular gasket interfaces with the facing surface of the heater as though the heater surface were the parting surface.

In either case, the heater transfers heat to the parting surfaces almost exclusively by conduction. The heating element is embedded in elastomer that is not only an electrical insulator, but has good heat conductivity. This allows the element temperature to be kept low, have long life, and to efficiently transfer heat to the casting, forging or stamping. By keeping the element temperature low and the heat conductivity high, there is a varied choice of elastomers for use.

IN THE DRAWINGS

DESCRIPTION OF PREFERRED EMBODIMENTS

The present invention comprises heating devices for heating metal stampings or castings of the type associated with engines, transmissions, differentials and the like. The heater is used to apply heat to components of such mechanical equipment that have parting surfaces of stampings or castings. The heater takes the shape of the gasket normally interposed between the parting surfaces. It is usable alone or together with other preheating system devices. The heater is used in conjunction with the gasket normally disposed between the parting surfaces, or in place of it. In one form of the invention, a heating element is embedded in an elastomer such a silicone rubber with a metal surface bonded to one side. The heater is bonded to one of the parting surfaces in a semi-permanent manner. The metal surface of the heater becomes the new parting surface. Upon reassembly of the components the usual gasket is put in place between the heater and the other parting surface.

According to a second form of the invention, a gasket shaped heater is made of an elastomer such as silicone rubber with a heating element embedded in it. This form of the invention is applicable to parting surfaces that have exactly matching surfaces and are not disassembled often. The invention provides for a fluid tight seal and for heat transfer into the casings or stampings by conduction in order to preheat the components.

The two forms of heaters made according to the present invention transfer heat to the parting surfaces almost exclusively by conduction. The heating element surface is embedded in an elastomer that is not only an electrical insulator, but has good heat conductivity. This allows the element temperature to be kept low, thus increasing the life of the element, and to efficiently transfer heat to the casting or stamping. The low element temperature and the high heat conductivity permit a varied choice of elastomers for use, such as neoprene, silicone or fluorosilicone.

Figure 1:
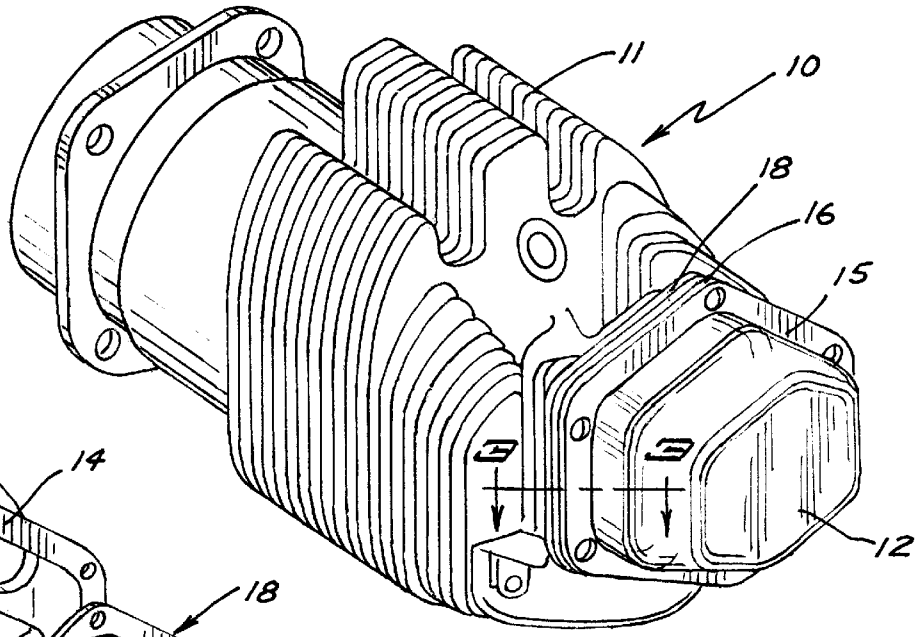
FIG. 1 is a perspective view of an aircraft cylinder with a heater according to a first form of the invention installed thereon.
Figure 2:
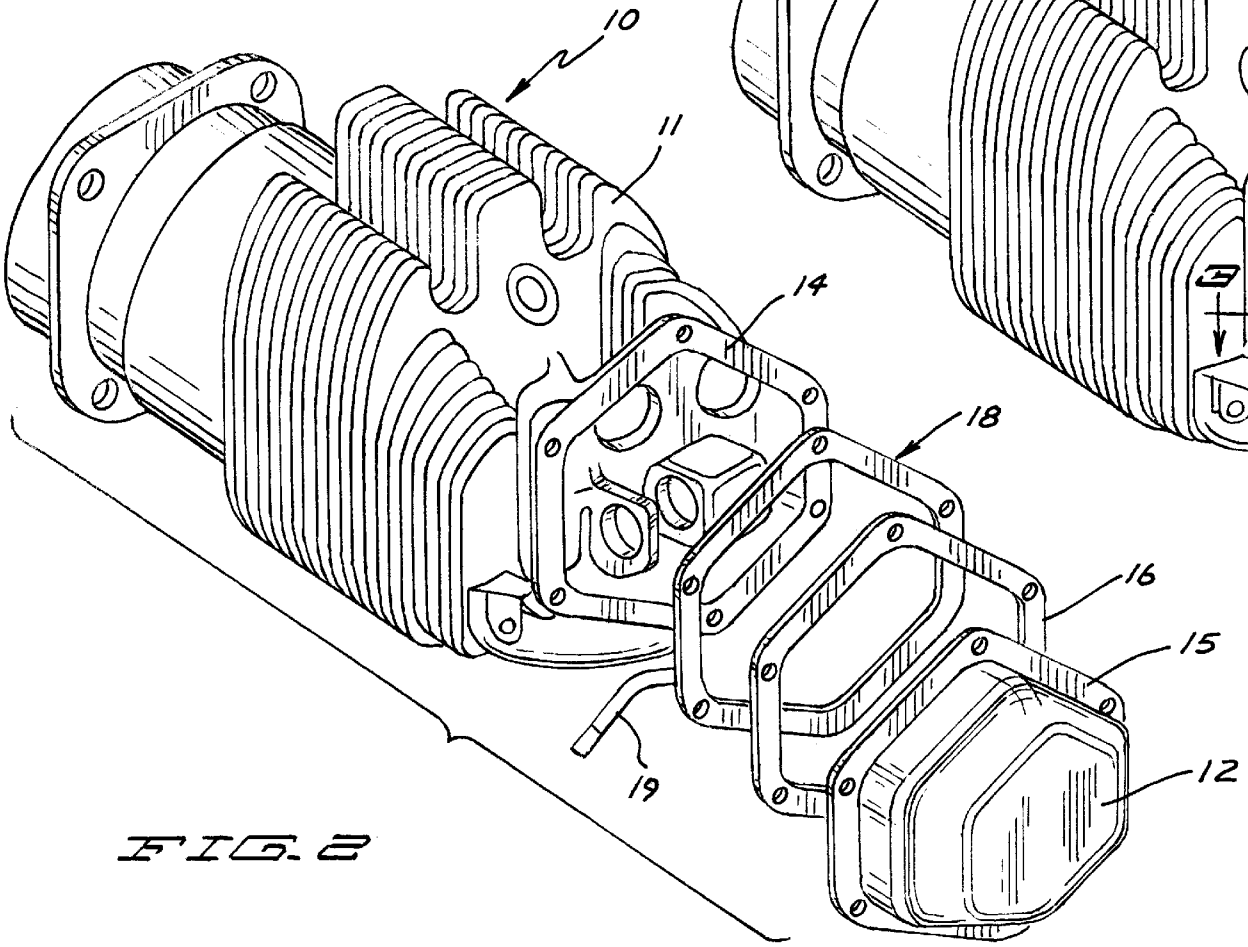
FIG. 2 is an exploded view in perspective of the aircraft cylinder and the heater of FIG. 1.

FIGS. 1 and 2 show a first form of heater according to the invention installed with respect to an aircraft cylinder. An aircraft cylinder 10 has a cylinder head 11 and a rocker cover 12. The rocker cover 12 is frequently disassembled from the cylinder head 11 for maintenance purposes. To this end the cylinder head 11 has a flanged parting surface 14 pentagonal in shape. The cover 12 has a peripheral flanged surface 15 corresponding in shape. An expendable gasket 16 is normally disposed between the parting surfaces 14, 15 for the purpose of creating a fluid tight seal. Upon each disassembly of the aircraft cylinder, it is necessary to replace the gasket 16.

A heater 18 according to the first form of the invention is installed between the parting surfaces 14, 15 and corresponds in shape to them. Normally the heater will be installed next to the parting surface of the more massive component, in this case the cylinder head 11. The gasket 16 is placed between the heater 18 and the second parting surface 15 of the rocker cover 12.

Heater 18 has a power lead 19 for connection to a suitable power source. When energized, the heater 18 preheats the aircraft cylinder 10 preparatory to and in order to facilitate starting of the aircraft engine.

Figure 3:
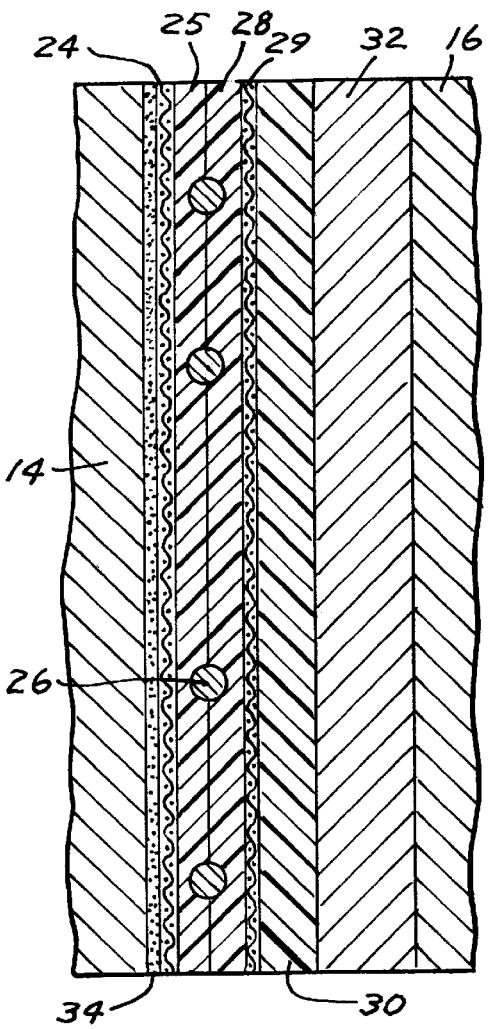
FIG. 3 is an enlarged sectional view of a portion of the aircraft cylinder of FIG. 1 taken along the line 3—3 thereof.
Figure 5:
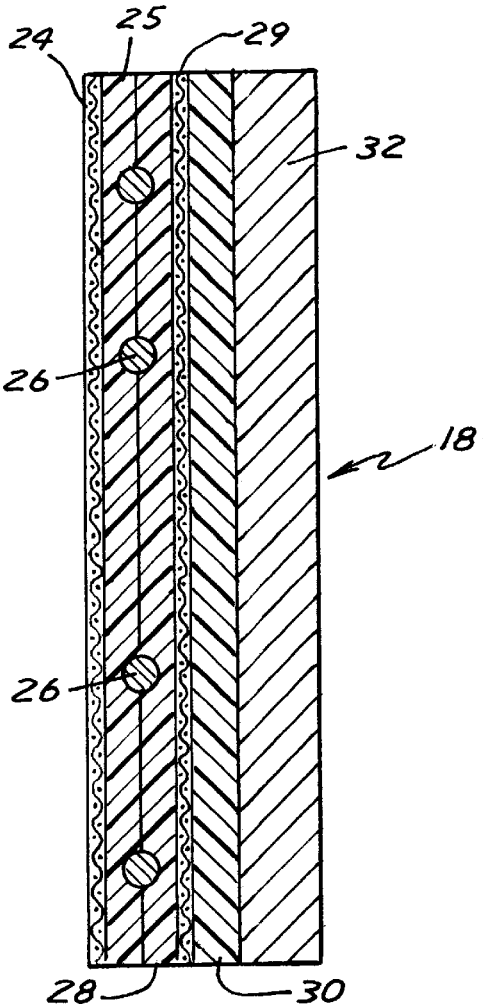
FIGS. 5 is an enlarged sectional view of a portion of the heater of FIG. 4 taken along the line 5—5 thereof.
Figure 4:
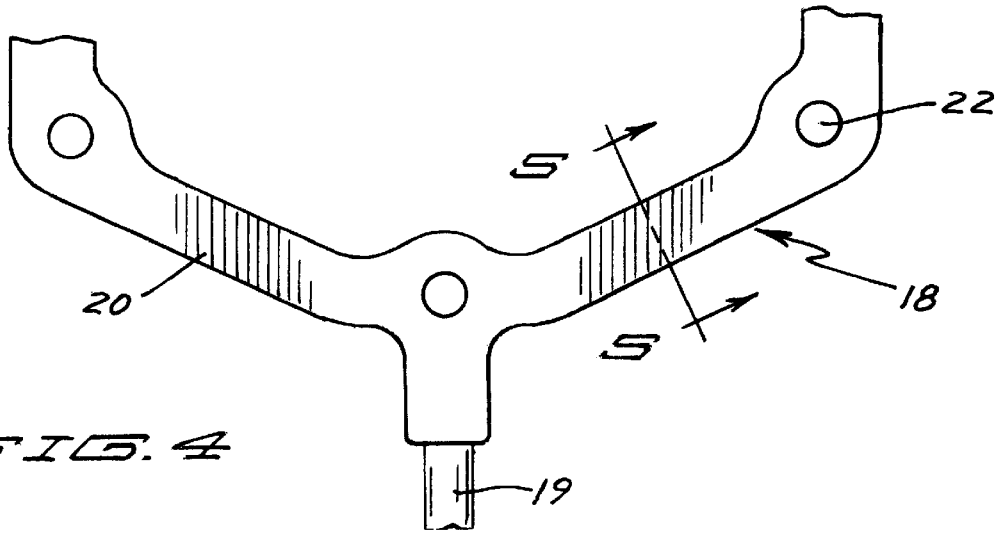
FIG. 4 is an enlarged plan view of a segment of the heater of FIG. 1.

Heater 18 is constructed pentagonal in shape with a central opening to correspond to the cylinder opening to the chamber of the cylinder block 11. Heater 18 has five equal length legs 20 with fastening openings 22 at the junctions thereof. Particular details of construction of the heater 18 are shown in FIGS. 3 through 5. FIG. 3 is a cross-sectional view through a leg 20 of the heater as it is installed between the parting surfaces of the aircraft cylinder. FIG. 5 is a cross-sectional view of the leg of heater 18 removed from the aircraft cylinder.

Heater 18 has one surface for bonding to one of the parting surfaces of the aircraft cylinder, and an opposite metallic surface to mimic the parting surface that it covers. The usual gasket is installed between the metallic surface of the heater and the opposite parting surface of the aircraft components which are then assembled in usual fashion.

More particularly, heater 18 is formed of a composite of layers of material encasing a heating element shown as a wire heater element 26. The heater element can take other forms. It can be an etched grid. It can be made of resistive ink which is entrained with metal or carbon particles. It can be resistive plastic, also entrained with such particles. The heater has a first layer of glass cloth 24 that is secured to or integral with a first elastomer layer such as a silicone rubber layer 25. A second elastomer layer 28 is adjacent the first layer 25. A wire heating element 26 is sandwiched between the first and second elastomer layers 25, 28. A second glass cloth layer 29 is fixed to the side of the second elastomer layer 28 opposite the wire heating element 26. A third elastomer layer or silicone rubber 30 is fixed to the second glass cloth layer 24. A metallic layer 32 is fixed to the third elastomer layer 30.

FIG. 3 shows heater 18 installed between the parting surfaces of the aircraft components. The first glass cloth layer 24 is bonded by a suitable bonding glue or cement 34 to the parting surface 14 of the cylinder 11. It is preferable to bond the heating element to the more massive of the parting surfaces for purposes of heat conduction. The metal layer 32 of the opposite face of the heater 18 is positioned against the standard gasket 16 that is interposed between the parting surfaces. The metal layer 32 presents a mimic of the parting surface 14 for purposes of interfacing the gasket 16.

In terms of construction of the heater 18, a sheet of fiberglass cloth impregnated with uncured silicone rubber is cut to the shape of the parting surfaces, or the shape of the gasket 16. The resistance wire or grid 26 is primed with a cleaner and is laid out on the surface of silicone rubber. Another layer of fiberglass cloth impregnated with uncured rubber is laid on top of the uncured silicone over the resistance wire. This layering comprises the electrical wire heating element 26, the first glass cloth layer and first rubber layer 24, 25 and the second rubber layer and second glass cloth layer 28, 29. The additional layer 30 of uncured silicone rubber is added to the outside surface. The metal layer, typically aluminum, in the shape of the parting surface, is primed and put on top of the exposed silicone surface. The resulting composite is placed in a press or an autoclave to cure. This provides an even pressure to keep the sides completely flat and parallel. By way of example, pressure is applied to the composite and it is heated to 350 degrees for 15 minutes to cure the silicone rubber.

The first layer of silicone rubber and glass cloth, 24, 25 is bonded to the parting surface 14 of the aircraft cylinder 11 by adhesive 34. It remains there in semi-permanent fashion on each disassembly and assembly of the rocker cover to the cylinder head. The metal surface 32 is outwardly facing to present a new parting surface as earlier described.

By further way of example, upon installation of the heater 18, the heater is adhered to the parting surface 14 by coating the first cloth/silicone rubber surface with an oil resistant sealant such as GE RTV 102 silicone, and putting it on the parting surface of the cylinder head. The rocker cover 12 is installed by means of bolts through the usual mounting holes aligned with the mounting holes 22 in the heater. The rocker cover provides bonding pressure, and the assembly is left to cure. After about eight hours the rocker cover can be removed and the heater will stay in place. It will have an oil tight seal to the cylinder head, and the exposed metal surface becomes a new parting surface. The cylinder is returned to service by reinstalling the rocker cover using a normal rocker cover gasket 16 on top of the metal surface of the heater 18.

Figure 6:
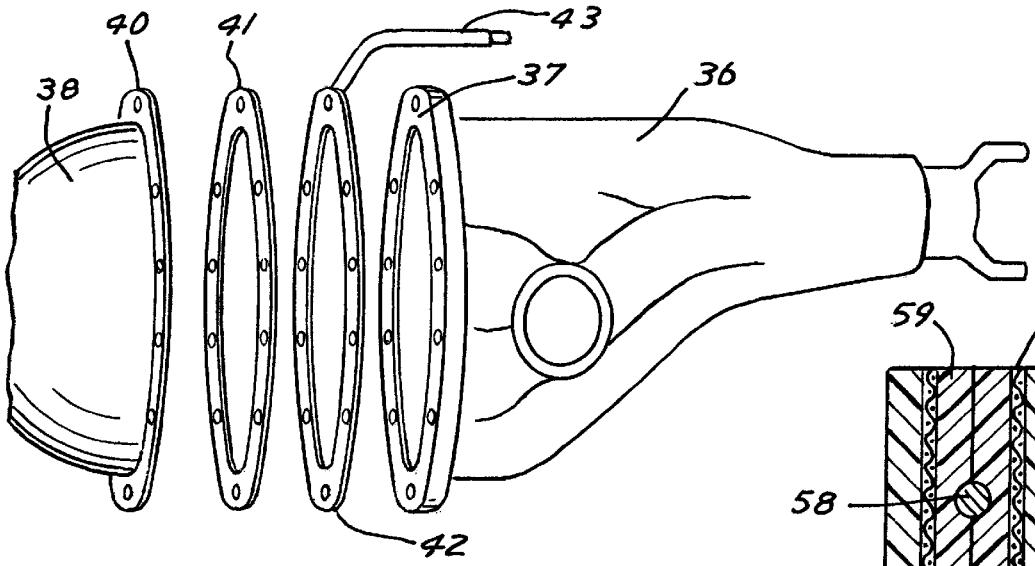
FIG. 6 is a side elevational exploded view of an automotive differential housing having a heater according to a first form of the invention.

FIG. 6 depicts another example of the use of a heater according to the first form of the invention, with respect to an automobile differential housing. A differential housing 36 has a flanged parting surface 37. A cover 38 with a corresponding flanged parting surface 40 is provided for assembly to the differential housing 36 containing the various differential gears encased in a suitable lubricant. A standard replaceable gasket 41 is located between the cover 38 and the housing 36.

A heater 42 according to a first form of the invention is installed between the parting surfaces of the differential assembly. Heater 42 has an electrical power lead 43. The heater 42 is bonded to the parting surface 37 as previously described, having a metallic surface that faces the replaceable gasket 41, thereby effectively creating a new parting surface.

The heater according to the first form of the invention finds numerous such applications. Such a heater is usable with the engine block/casing and sump on a vehicle or aircraft. It is usable in connection with rotor gear boxes of helicopters; manual transmission housings on automobiles; automatic transmission housings and the cylinder head to valve cover connection on automotive type engines.

Figure 7:
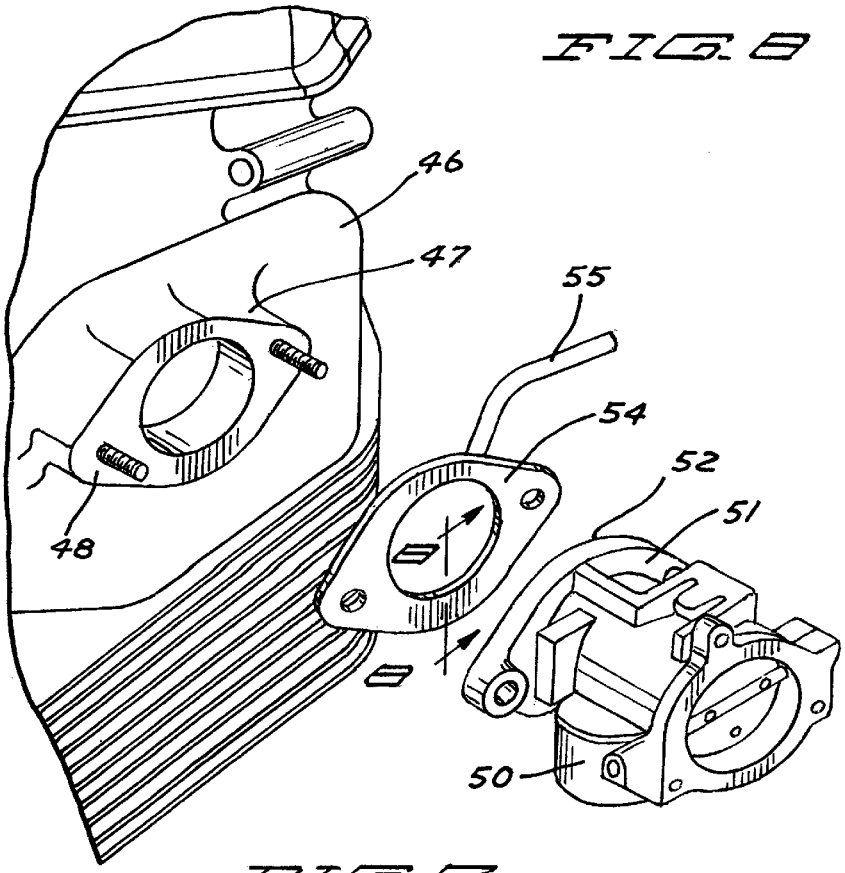
FIG. 7 depicts an exploded view a snowmobile engine block and a snowmobile carburetor housing along with a heater according to a second form of the invention.

A heater according to the second form of the invention is constituted as a gasket that replaces the gasket normally interposed between parting surfaces. This form of the invention is applicable to those installations where the parting surfaces are only infrequently disassembled. The first example of such an installation is that of a snowmobile engine carburetor installation shown in FIG. 7. A snowmobile engine has a snowmobile engine block 46 which has a carburetor mount 47 exposing a parting surface 48. A carburetor housing 50 has a mounting flange 51 which presents a second parting surface 52. The parting surfaces 48, 52 are mating and define a central carburetor opening. Normally a gasket is interposed between these two surfaces. In this instance, a gasket heater 54 according to the second form of the invention is interposed. Gasket heater 54 has a power lead 55 for connection to a suitable source of electrical power.

Figure 8:
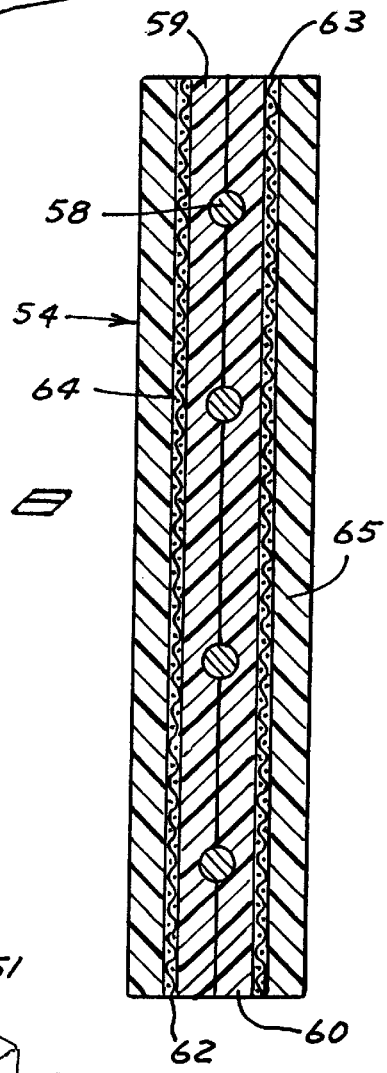
FIG. 8 is an enlarged sectional view of a portion of the heater of FIG. 7 taken along the line 8—8 thereof.

The construction of the gasket 54 is better seen in FIG. 8 showing an enlarged cross-sectional view thereof. A wire heater element 58 is embedded between a first elastomer layer 59 of silicone rubber or equivalent material, and a second elastomer layer 60 of the same material. A first glass cloth layer 62 is fixed or integral with the surface of the first elastomer layer 59 opposite the heater element 58. A second glass cloth layer 63 is similarly fixed to the second elastomer layer 60. A third elastomer layer 64 is fixed to the first layer of glass cloth 62. A forth elastomer layer 65 is fixed to the second layer of glass cloth 63. The outer silicone rubber layers 64, 65 present gasket like surfaces that interface the parting surfaces 48, 52 of the snowmobile components.

In the installation thereof, the gasket heater 54 is simply disposed between the parting surfaces 48, 52 in the fashion of the standard gasket. In certain instances a heater can be interposed between surfaces where there was previously no gasket.

Figure 9:
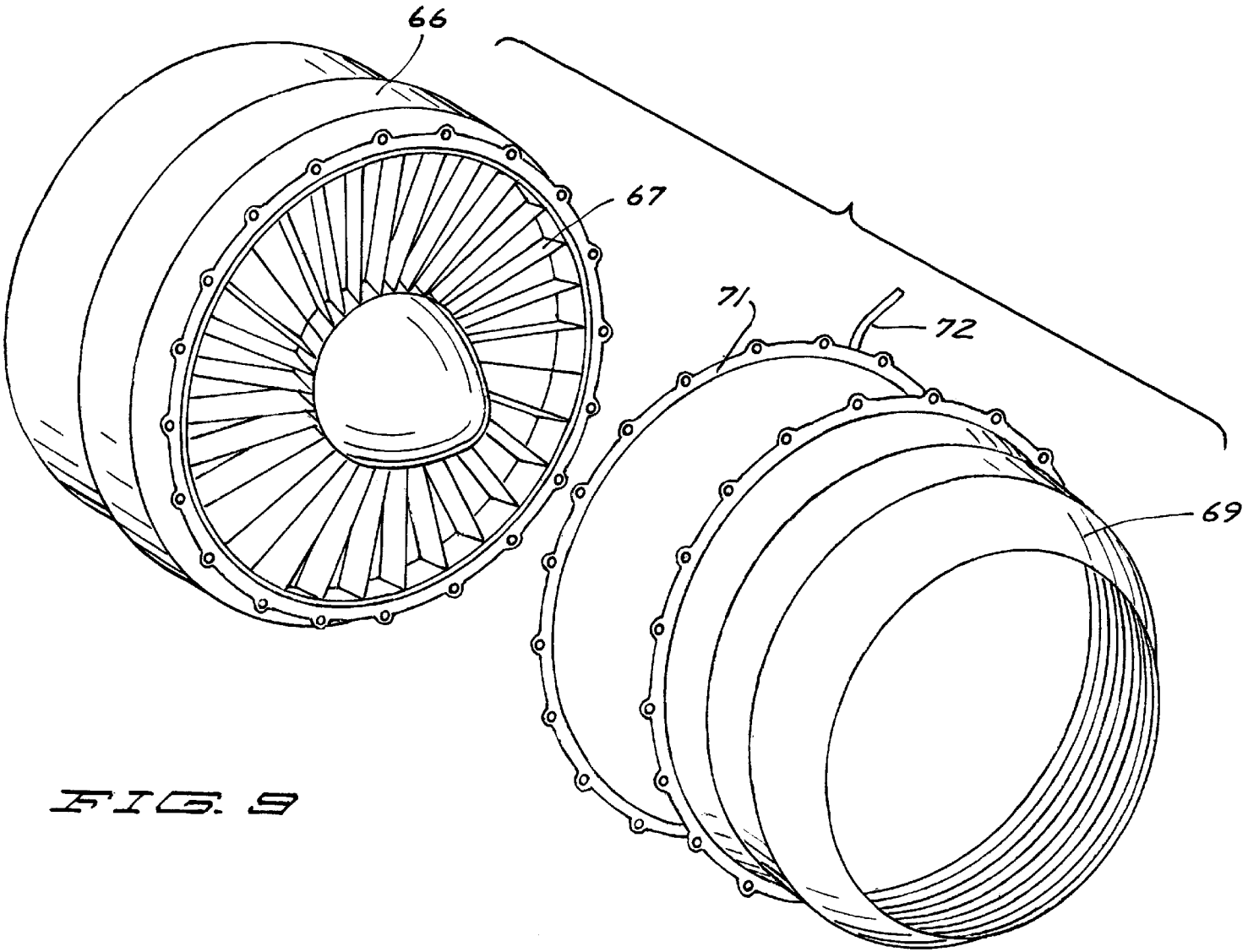
FIG. 9 is an exploded view in perspective of a portion of a turbo fan engine having a heater according to the second form of the invention.

Another application of this second form of gasket shaped heater is shown in FIG. 9 installed with respect to an aircraft turbofan engine. The engine has a compressor/fan housing 66 that carries the turbofan vanes 67. The turbofan engine also has an inlet duct housing 69. The housings 66, 69 have facing parting surfaces. A gasket heater 71 having a power lead 72 is interposed between the parting surfaces of the two housings 66, 69 and replaces the normal gasket used between them. The application of electrical energy at the power lead 62 results in heating the gasket heater 71 in order to preheat the elements of the turbo fan engine prepatory to and to facilitate starting it. The gasket heater 71 is constructed in cross sectional view like that shown in FIGS. 7 and 8.

Figure 11:
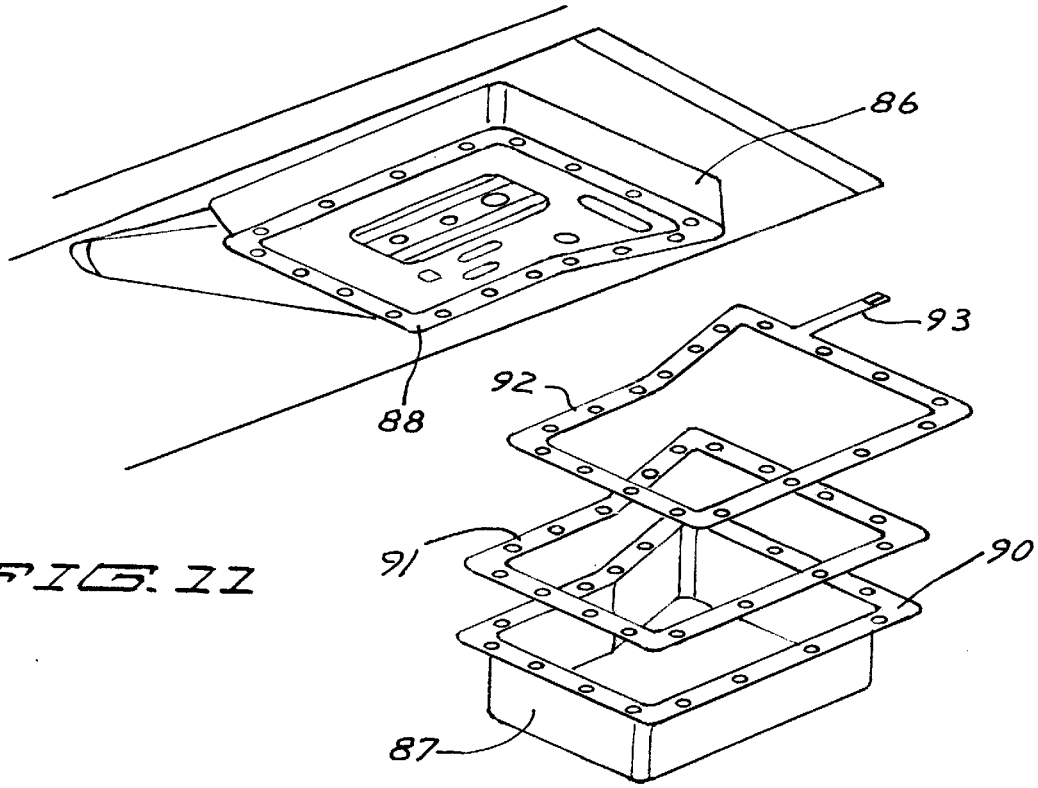
FIG. 11 is an exploded view of an automotive transmission housing having a heater according to the first form of the invention.
Figure 10:
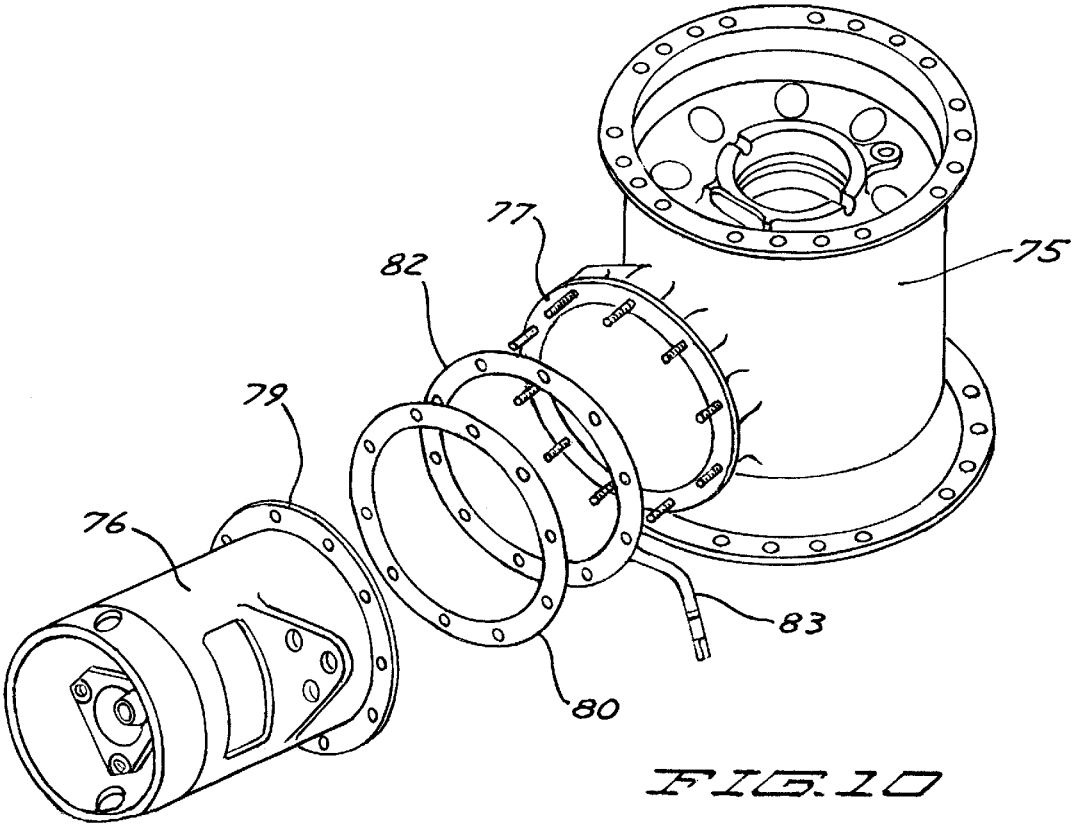
FIG. 10 is an exploded view of a helicopter main rotor gear box assembly having a heater according to the first form of the invention.

Other examples of installations employing a heater according to the first form of the invention are shown in FIGS. 10 and 11. FIG. 10 illustrates the use of a heater according to the first form of the invention in connection with the main rotor gear box of a helicopter. A main rotor gear box is shown at 75 in FIG. 10. An accessory drive case 76 is connectable to the main rotor gear box 75. The accessory drive case 76 will carry an accessory such as a generator, hydraulic pump or the like, driven by the main shaft passing through the rotor gear box 75. The main gear box 75 has a flanged parting surface 77. The accessory drive case 76 has a corresponding flange parting surface 79. A gasket 80 is normally interposed between the parting surfaces. A heater 82 according to the first form of the invention is also disposed between the parting surfaces. The heater 82 has a power lead 83 for connection to a suitable source of power for purposes of preheating the components and lubricating fluids contained in and between the main rotor gear box 75 and the accessory drive case 76.

FIG. 11 illustrates an installation of a heater according to the first form of the invention with respect to an automotive transmission housing and transmission oil pan installation. The lower portion of the automotive transmission housing is indicated at 86 and normally has assembled to it a transmission oil pan 87. The lower part of the housing 86 has a parting surface 88 that attaches to the flanged parting surface 90 of the oil pan 87. A gasket 91 is normally interposed between the surfaces. A heater 92 is shaped according to the gasket 91 and is interposed between the gasket 91 and the parting surface 88 of the transmission housing 86. The heater 92 has an electrical lead 93 for connection to a remote power source such as an alternating current power source. The heater 92 is effective to preheat the transmission fluid in order to facilitate initial cold whether operation of the automotive transmission.

Figure 12:
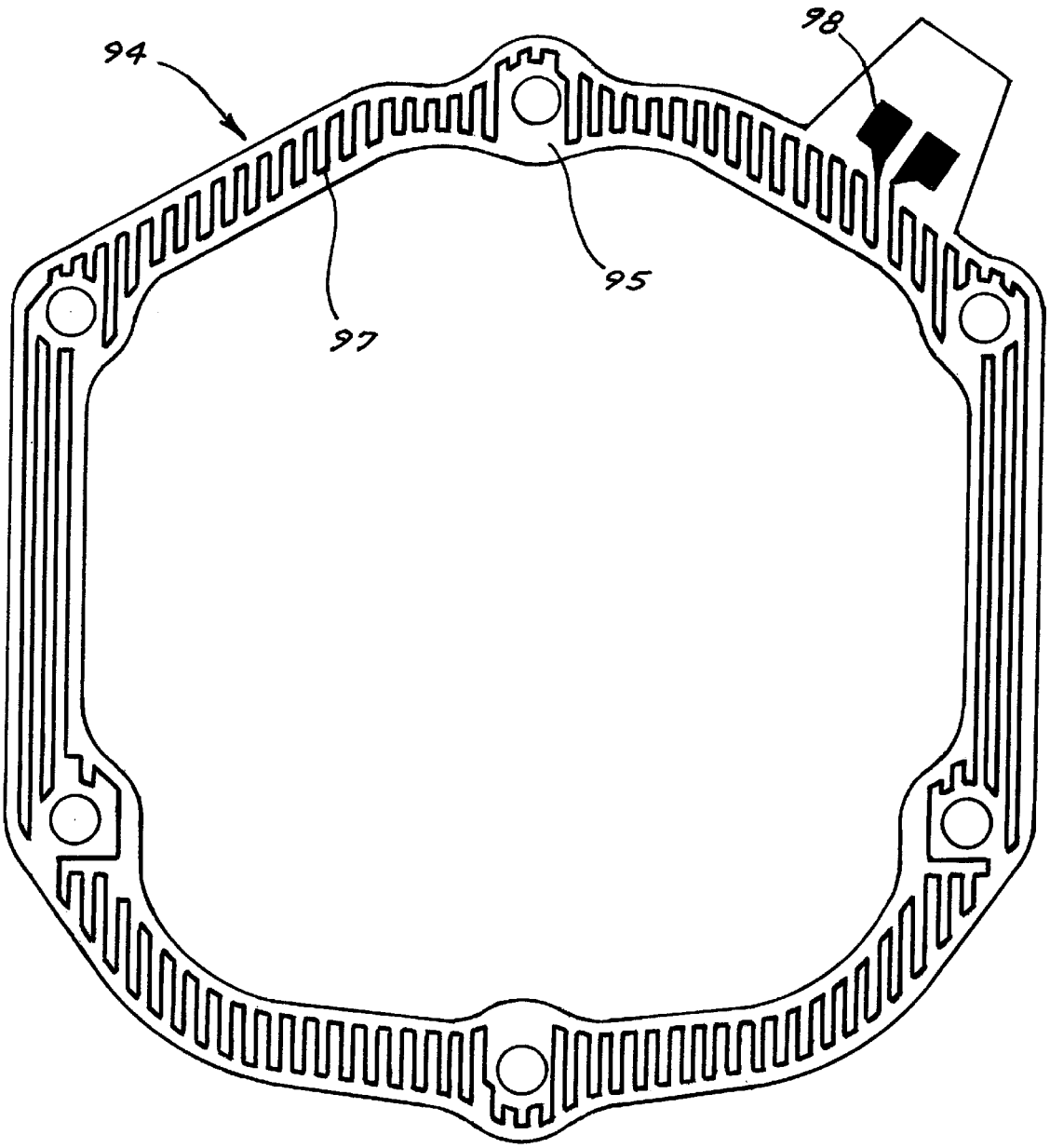
FIG. 12 is a plan view of a alternative form of heating element for use in heaters according to the invention..

FIG. 12 illustrates an alternative embodiment of a heater element for use in the first and second forms of heaters of the invention. A heater element 94 has a non conductive base 95 which is formed in the gasket shape of the intended heater. The base 95 carries an etched grid 97 which terminates in sodder leads 98. The etched grid 97 forms the resistive segment of the heater element. In use, the heater element 94 is disposed of between layers of elastomer like the heater element 58 shown in FIG. 8.

Certain applications for heaters according to first and second forms of the invention have been illustrated herein. It will be apparent that many other applications are available for these forms of heaters.

The embodiments of the invention in which an exclusive property or privilege is claimed are defined as follows:

1. A gasket shaped heater for installation with respect to a housing of the type having first and second parting surfaces joined with a standard gasket interposed between them, comprising:

a first elastomer layer shaped according to a standard gasket adapted to be interposed between a first and second parting surfaces of a housing;

a second elastomer layer shaped like said first elastomer layer and joined to said first elastomer layer;

a heater element embedded between the first and second elastomer layers;

a power lead connected to the heater element;

a metallic layer fixed to the second elastomer layer;

a standard gasket positioned adjacent the metallic layer on the side of the metallic layer opposite the second elastomer layer;

means bonding the first elastomer layer to a first of the parting surfaces with the metallic layer facing away from the first parting surface whereby the metallic layer effectively becomes a new parting surface interfacing with said standard gasket.

2. The heater of claim 1 including:

a first glass cloth layer integral with the first elastomer layer;

a second glass cloth layer integral with the second elastomer layer.

3. A gasket shaped heater for installation with respect to a housing of the type having first and second parting surfaces joined with a standard gasket interposed between them, comprising:

a first elastomer layer shaped according to a standard gasket adapted to be interposed between a first and second parting surfaces of a housing;

a second elastomer layer shaped like and joined to said first elastomer layer;

a first glass cloth layer integral with the first elastomer layer and a second glass cloth layer integral with the second elastomer layer;

a heater element embedded between the first and second elastomer layers;

a power lead connected to the heater element;

a metallic layer fixed to the second elastomer layer;

a third elastomer layer connected to the second glass cloth layer, said metallic layer being connected to the third elastomer layer;

whereby the first elastomer layer is adapted to be bonded to a first of the parting surfaces with the metallic layer facing away from the first parting surface and effectively becoming a new parting surface for interfacing with the standard gasket.

4. The heater of claim 3 wherein:

said elastomer is silicone rubber.

5. The heater of claim 3 wherein:

said elastomer is neoprene.

6. The heater of claim 3 wherein:

said heater element is made of a heater wire.

7. The heater of claim 3 wherein:

said heater element is made of an etched grid.

8. The heater of claim 3 wherein:

said heater is formed by cutting a first sheet of fiberglass cloth impregnated with uncured silicone rubber to the shape of the standard gasket;

placing a resistance wire on a surface of the silicone rubber of the first sheet;

cutting a second sheet of fiberglass cloth impregnated with uncured silicone rubber to the shape of the standard gasket and placing it next to the first sheet with the resistance wire in between;

placing a third sheet of uncured silicone rubber cut to the shape of the standard gasket, on the second sheet;

placing a metallic sheet cut to the shape of the standard gasket on the third sheet;

curing the composite in a press or an autoclave.

9. A gasket shaped heater for installation with respect to a housing of the type having first and second parting surfaces joined with a standard gasket interposed between them, comprising:

a first elastomer layer shaped according to a standard gasket adapted to be interposed between a first and second parting surfaces of a housing;

a second elastomer layer shaped like said first elastomer layer and joined to said first elastomer layer;

a heater element embedded between the first and second elastomer layers;

a first glass cloth layer integral with the first elastomer layer on the side opposite the heater element;

a second glass cloth layer integral with the second elastomer layer on the side opposite the heater element;

a power lead connected to the heater element;

whereby the composite structure of the elastomer and glass cloth layers are placed between the parting surfaces in place of a standard gasket with the power lead extending therefrom;

a third elastomer layer connected to the second glass cloth layer.

10. The heater of claim 9 including:

a fourth elastomer layer connected to the first glass cloth layer.

11. The heater of claim 10 wherein:

said elastomer is silicone rubber.

12. The heater of claim 10 wherein:

said elastomer is neoprene.

13. The heater of claim 9 wherein:

said heater element is a heater wire.

14. The heater of claim 9 wherein:

said heater is formed by cutting a first sheet of fiberglass cloth impregnated with uncured silicone rubber to the shape of the standard gasket;

placing a resistance wire on the surface of the silicone rubber of the first sheet;

cutting a second sheet of fiberglass cloth impregnated with uncured silicone rubber to the shape of the standard gasket and placing it next to the first sheet with the resistance wire in between;

placing a third sheet of uncured silicone rubber cut to the shape of the standard gasket, on the second sheet;

curing the composite in a press or an autoclave.

15. The heater of claim 12 wherein:

said elastomer is neoprene.

* * * * *